US008366461B2

(12) United States Patent
Lee et al.

(10) Patent No.: US 8,366,461 B2
(45) Date of Patent: Feb. 5, 2013

(54) ELECTRICAL PLUG HAVING ROTATABLE PRONGS

(75) Inventors: Yu-Lung Lee, Miaoli County (TW); Jung-Hui Hsu, Taipei County (TW); Ming-Chou Kuo, Taipei (TW); Mei-Ju Lin, Taipei County (TW)

(73) Assignee: Powertech Industrial Co., Ltd., Taipei Hsien (TW)

( * ) Notice: Subject to any disclaimer, the term of this patent is extended or adjusted under 35 U.S.C. 154(b) by 171 days.

(21) Appl. No.: 12/907,171

(22) Filed: Oct. 19, 2010

(65) Prior Publication Data

US 2011/0097911 A1 Apr. 28, 2011

Related U.S. Application Data

(63) Continuation-in-part of application No. 12/694,535, filed on Jan. 27, 2010, now Pat. No. 8,096,817.

(30) Foreign Application Priority Data

Oct. 28, 2009 (TW) ..... 98136466 A

(51) Int. Cl.
*H01R 29/00* (2006.01)

(52) U.S. Cl. ..... 439/131

(58) Field of Classification Search ..... 439/104, 439/131

See application file for complete search history.

(56) References Cited

U.S. PATENT DOCUMENTS

| | | | | | |
|---|---|---|---|---|---|
| 2,984,808 | A * | 5/1961 | Bender | 439/104 |
| 3,027,507 | A * | 3/1962 | Hubner | 320/111 |
| 4,191,917 | A * | 3/1980 | Brown et al. | 320/111 |
| 4,467,263 | A * | 8/1984 | Conforti et al. | 320/111 |
| 4,543,624 | A * | 9/1985 | Rumble | 363/146 |
| 5,611,701 | A * | 3/1997 | Hahn | 439/131 |
| 5,628,641 | A * | 5/1997 | Hahn | 439/131 |
| 5,635,814 | A * | 6/1997 | Afzal et al. | 320/111 |
| 6,062,880 | A * | 5/2000 | Skuza | 439/131 |
| 6,454,578 | B1 * | 9/2002 | Yao | 439/131 |
| 6,722,900 | B2 * | 4/2004 | Segawa et al. | 439/131 |
| 6,780,033 | B2 * | 8/2004 | Liu | 439/172 |
| 6,939,150 | B1 * | 9/2005 | Lanni | 439/131 |
| 7,001,196 | B1 * | 2/2006 | Huang | 439/320 |
| 7,354,286 | B1 * | 4/2008 | Lee | 439/172 |
| 7,503,779 | B1 * | 3/2009 | Yang et al. | 439/131 |
| 7,604,492 | B1 * | 10/2009 | Wang | 439/131 |
| 7,833,029 | B2 * | 11/2010 | Choi et al. | 439/135 |
| 8,096,817 | B2 * | 1/2012 | Lee et al. | 439/104 |
| 8,182,274 | B1 * | 5/2012 | Cheng et al. | 439/131 |
| 2009/0061668 | A1 * | 3/2009 | Powell et al. | 439/174 |

* cited by examiner

*Primary Examiner* — Neil Abrams

(74) *Attorney, Agent, or Firm* — Rosenberg, Klein & Lee

(57) ABSTRACT

An electrical plug includes a base having an accommodating portion, a first hinge member rotatably disposed in the accommodating portion and having a recess, a first prong having one end connected to the first hinge member, a second prong having one end connected to the first hinge member. And the recess is disposed between the first prong and the second prong, a second hinge member is rotatably disposed in the accommodating portion, and a third prong has one end connected to the second hinge member. The first prong and the second prong are rotated by the first hinge member to be selectively received in the accommodating portion, and when the first prong and the second prong are received in the accommodating portion, the third prong is selectively rotated to be received in the recess.

9 Claims, 7 Drawing Sheets

ELECTRICAL PLUG HAVING ROTATABLE PRONGS

REFERENCE TO PRIOR NON-PROVISIONAL APPLICATION

This application is a continuation-in-part of U.S. patent application Ser. No. 12/694,535, filed Jan. 27, 2010, and now is issued as U.S. Pat. No. 8,096,817.

BACKGROUND OF THE INVENTION

1. Field of the Invention

The present invention relates to an electrical plug, especially to an electrical plug in which prongs can be received therein.

2. Description of Prior Art

Conventional electrical plugs have two or three prongs and can be applied to sockets having two or three receptacles respectively. The electrical plug with two prongs can be applied to a socket having two or three receptacles, whereas the electrical plug with three prongs can only be applied to a socket having three receptacles. When a socket with three receptacles is not available, the ground prong of the plug with three prongs is often removed so as to be applied to the socket with two receptacles.

To solve the problem, a conventional electrical plug is provided with a ground prong capable of being folded and received in the plug, whereby the electrical plug with three prongs is easily applied to the socket of two receptacles. The removal of the ground prong, however, may cause electricity leakage and result in security problem.

SUMMARY OF THE INVENTION

The objective of the invention is to provide an electrical plug capable of accommodating prongs thereof according to a specific sequence.

An electrical plug of the invention comprises a base having an accommodating portion, a first hinge member rotatably disposed in the accommodating portion and having a recess, a first prong having one end connected to the first hinge member, a second prong having one end connected to the first hinge member. And the recess is disposed between the first prong and the second prong, a second hinge member is rotatably disposed in the accommodating portion, and a third prong has one end connected to the second hinge member. The first prong and the second prong are rotated by the first hinge member to be selectively received in the accommodating portion, and when the first prong and the second prong are received in the accommodating portion, the third prong is selectively rotated to be received in the recess.

The third prong may be selectively received in the recess only when the first prong and the second prong have been received in the accommodating portion. When the electrical plug is to be connected to the socket, the third prong may protrude before protrusions of the second and third prongs.

In addition, the invention also provides an electrical plug comprises a base having an accommodating portion, a first hinge member rotatably disposed in the accommodating portion and having a recess, a first prong having one end connected to the first hinge member, a second prong having one end connected to the first hinge member. And the recess is disposed between the first prong and the second prong, a second hinge member is rotatably disposed in the accommodating portion, a linkage portion connects the first hinge member and the second hinge member in such a manner that the first hinge member and the second hinge member rotate in opposite directions simultaneously, and a third prong has one end connected to the second hinge member. The first prong and the second prong are rotated by the first hinge member to be selectively received in the accommodating portion, and when the first prong and the second prong are received in the accommodating portion, the third prong is selectively rotated to be received in the recess.

The linkage portion connects the first hinge member and the second hinge member and causes the first hinge member and the second hinge member to rotate in opposite directions simultaneously. The third prong has one end connected to the second hinge member and may rotate along with the first and second prongs in order to be received within the recess.

The invention also provides an electrical plug comprising a base having an accommodating portion, a live prong having one end rotatably disposed in the accommodating portion, a neutral prong adjacent to the live prong and having one end rotatably disposed in the accommodating portion, and a ground prong adjacent to the live prong and the neutral prong and having one end rotatably disposed in the accommodating portion. The live prong and the neutral prong are received in the accommodating portion, and the ground prong is selectively received between the live prong and the neutral prong.

When the live prong and the neutral prong are received in the accommodating portion, the ground prong is selectively received between the live prong and the neutral prong. The live prong and the neutral prong are received before the receipt of the ground prong.

The prongs of the electrical plug of the invention may thus be accommodated in a limited space, and the previously-mentioned electricity leakage, which may take place as the result of the application of the live prong and the neutral prong only after the receipt of the ground prong, may be reduced.

DETAILED DESCRIPTION OF THE INVENTION

Figure 1A:
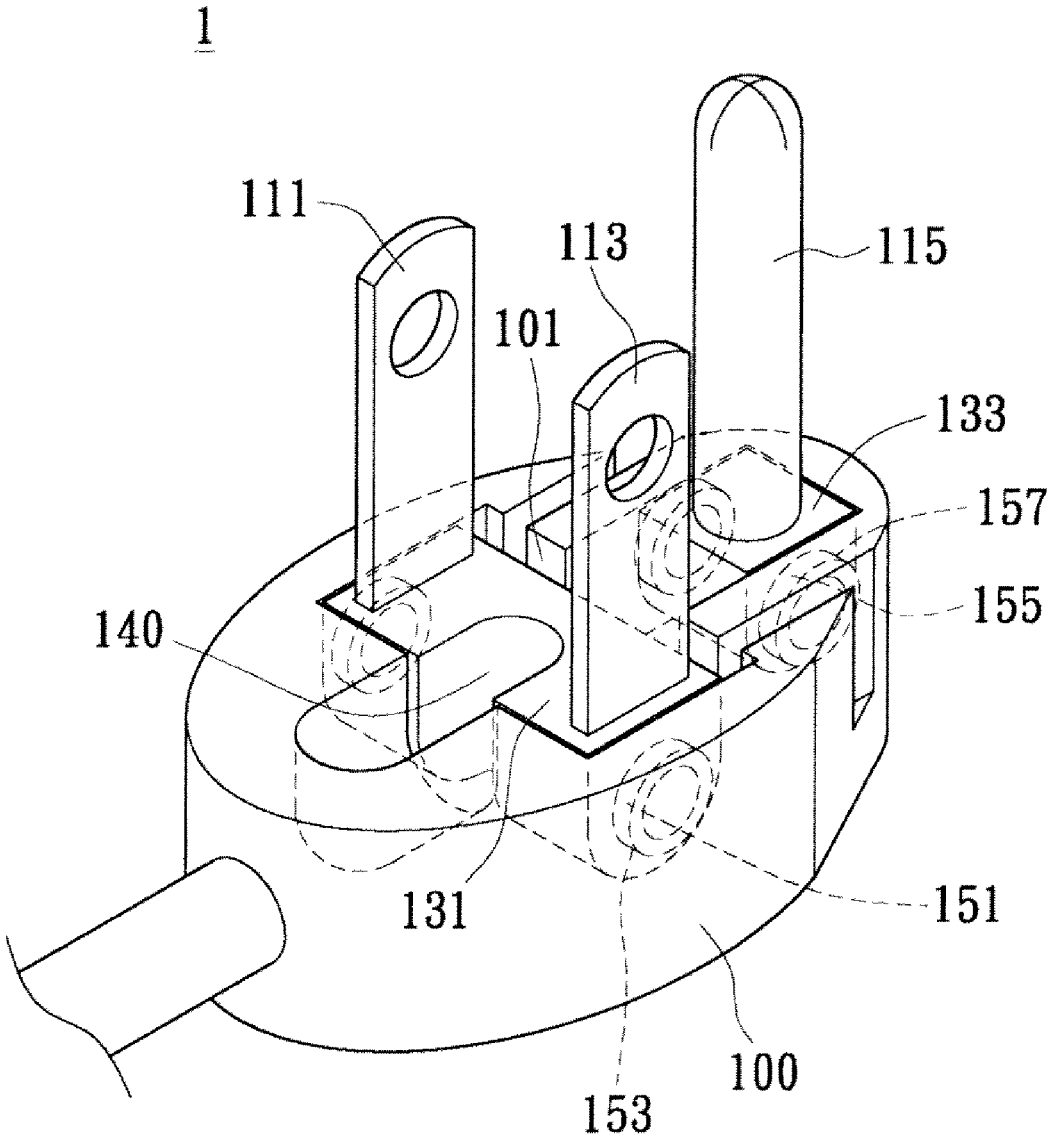
FIGS. 1A to 1C are schematic views of an electrical plug in accordance with a first embodiment of the present invention.
Figure 1B:
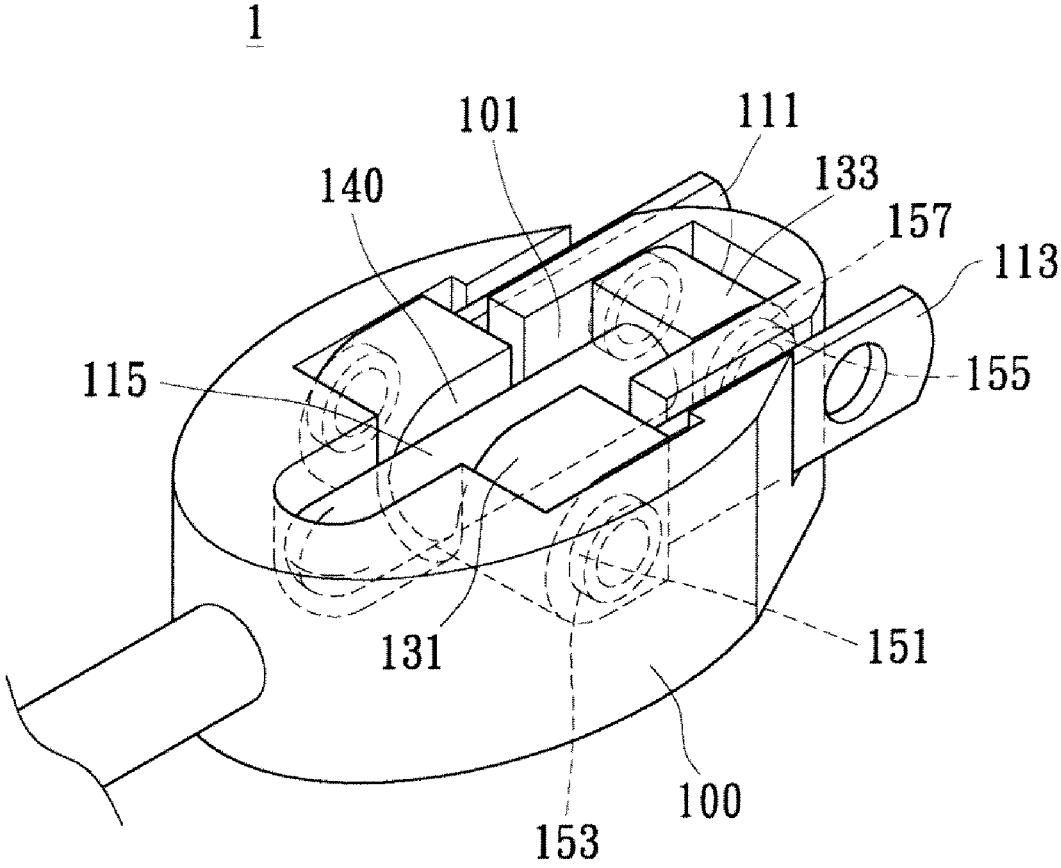
Figure 1C:
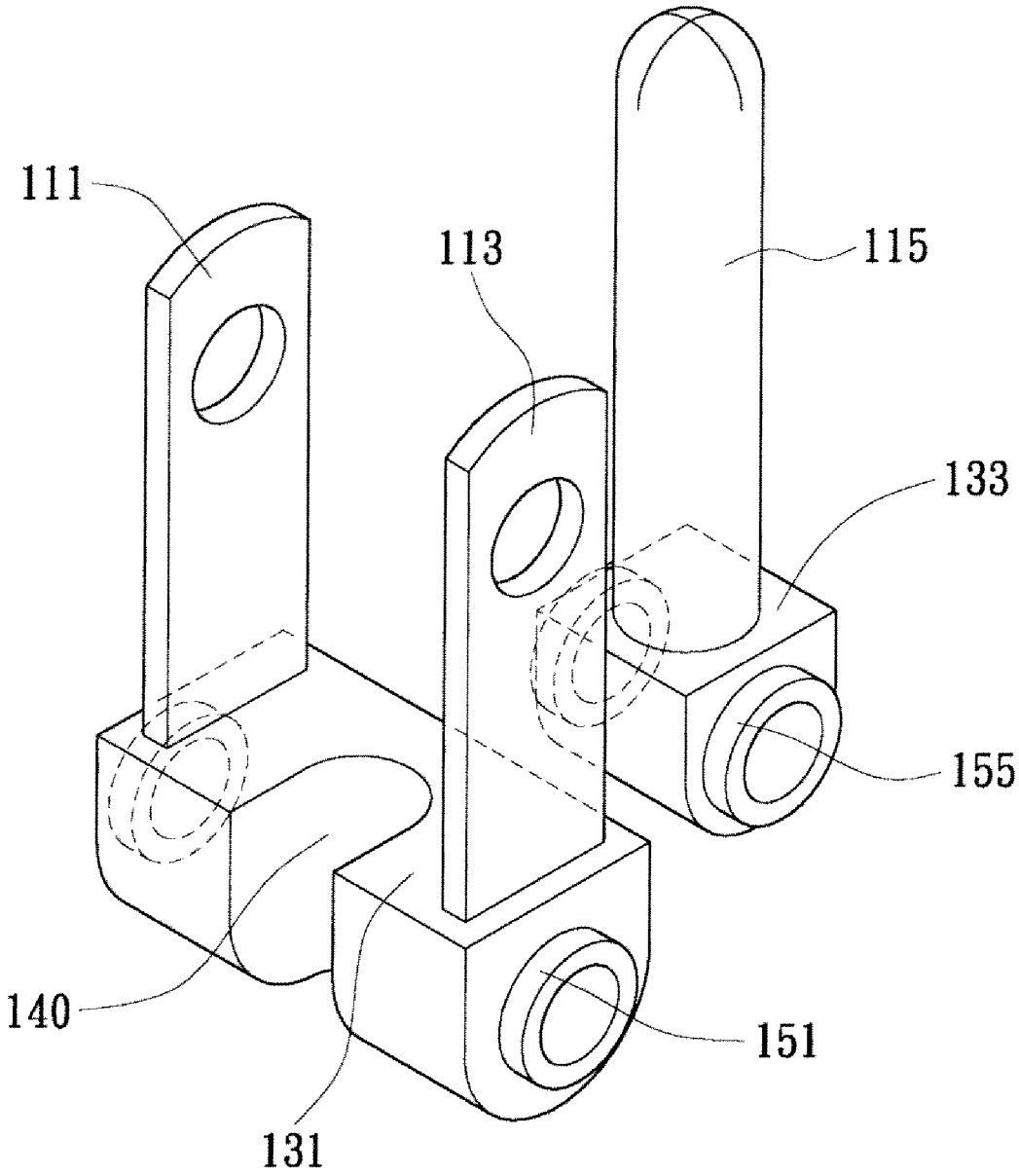

Referring to FIGS. 1A to 1C, an electrical plug 1 comprises a base 100, a first prong 111, a second prong 113, a third prong 115, a first hinge member 131, and a second hinge member 133. The base 100 has an accommodation portion 101. The first hinge member 131 and the second hinge member are rotatably disposed in the accommodating portion 101. One end of the first prong 111 and one end of the second prong 113 are connected to the first hinge member 131, and the first prong 111 and the second prong 131 are close to two ends of the first hinge member 131. One end of the third prong 115 is connected to the second hinge member 133.

In this embodiment, the size of the accommodating portion 101 may accommodate the first hinge member 131, the second hinge member 133, the portion of the first prong 111 protruding from the first hinge member 131, and the portion of the second prong 113 protruding from the first hinge member 131. The first prong 111 and the second prong 113 are selectively received in the accommodating portion 101 according to the rotation of the first hinge member 131. More specifically, the first prong 111 and the second prong 113 may protrude from the base 100 or be received in the base 100 depending on the rotational angle of the first hinge member 131. When the first prong 111 and the second prong 113 protrudes from the base 100, the first prong 111 and the second prong 113 is vertical to the surface of the base 100. When the first prong 111 and the second prong 113 are received in the base 100, the first prong 111 and the second prong 113 may be inclined by a predetermined angle with respect to the base 100. The third prong 115 may protrude or be inclined with respect to the base 100 depending on the rotation of the second hinge member 133. When the first prong 111 and the second prong 113 are received in the accommodating portion 101, the first prong and the second prong 113 is inclined in a direction toward the third prong 115, and the third prong 115 is inclined in another direction toward the first and second prongs 111 and 113 and positioned between the first prong 111 and the second prong 113. In other words, in one implementation, the third prong 115 is "sandwiched" by the first prong 111 and the second prong 113.

The first hinge member 131 has a recess 140 disposed on one side thereof. The recess 140 is between the first and second prongs 111 and 113. When the first prong 111 and the second prong 113 are rotated along with the first hinge member 131 and received in the accommodating portion 101, the third prong 115 may be received in the recess 140. It is worth noting that the recess 140 may be at a predetermined position so as to ensure the third prong 115 may not be received in recess before the receptions of the first prong 111 and the second prong 113 in the accommodating portion 101. Consequently, the first prong 111 and the second prong 113 may not be utilized when the third prong 115 has been received, reducing the likelihood of the electricity leakage.

In the embodiment, two first shafts 151 are disposed on two sides of the first hinge member 131, and two first holes 153 corresponding to the two first shafts 151 are formed inside of the base 100, whereby the first hinge member 131 and the second hinge member 133 are rotatable in the accommodating portion 101. Alternatively, the first shafts 151 may be disposed inside of the base 100 with the first holes 153 formed on the first hinge member 131. Similarly, the second shafts 155 may be disposed inside of the base 100 and the first holes 157 may be formed on the first hinge member 131. Accordingly, the first prong 111, the second prong 113, and the third prong 115 may protrude or be received with respect to the base 100.

As shown in FIG. 1B, when the first prong 111 and the second prong 113 are received in the accommodating portion 101, the first prong 111 and the second prong 113 are close to two sides of the second hinge member 133, and the third prong 115 is allowed to be received in the recess 140 after the first and second prongs 111 and 113 are received in the accommodating portion 101. When the third prong 115 is received in the recess 140, the first prong 111 and the second prong 113 may have been received in the accommodating portion 101 already. In operation, the portion of first prong 111 and the second prong 113 protruding from the accommodating portion 101 may be manually pushed to cause the entire first prong 111 and the second prong 113 to be protruding from the accommodating portion 101. When the first hinge member 131 is rotated, the third prong 115 may be pushed to be inclined by a larger angle with respect to the base 100, facilitating the entire third prong 115 to be protruding from the recess 140 by manual pushing of the protruding portion of the third prong 115.

The electrical plug 1 may be applied to all electronic devices and outlets needing electrical plug. The base 100 may be an insulating body of an arbitrary shape. The first prong 111, the second prong 113, and the third prong 115 may be metal pieces. The first prong 111 may be a live prong, the second prong 113 may be a neutral prong 113 and the third prong 115 may be a ground prong. Alternatively, the first prong 111 may be the neutral prong, and the second prong 113 may be the live prong.

Figure 2:
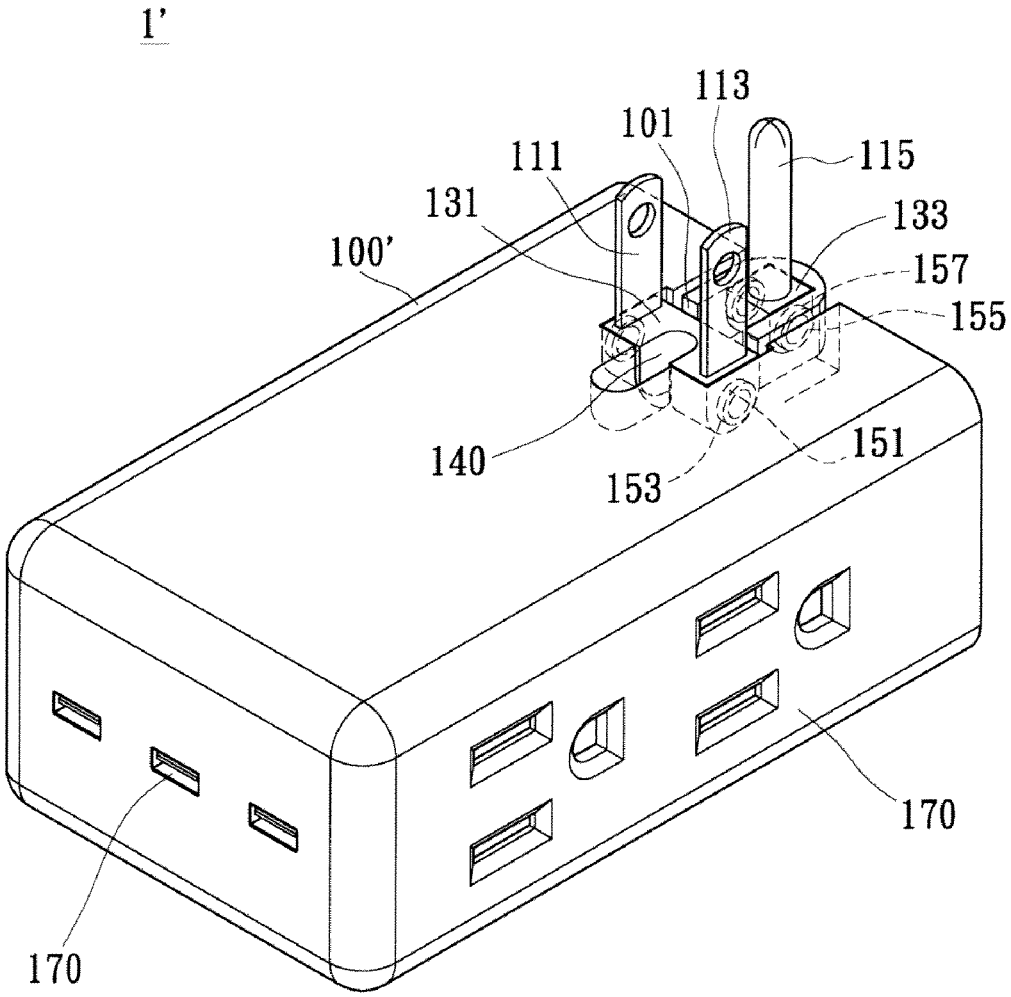
FIG. 2 is a schematic view of the electrical plug in accordance with a second embodiment of the present invention.

Referring to FIG. 2, an electrical plug 1' is substantially similar to the first embodiment shown in FIG. 1. The electrical plug 1' of this embodiment may be a charger or an adapter to increase the amount of outlets. In this embodiment, the base 100' has a plurality of receptacles 170 for electrical plugs of different types, such as an USB plug.

In the current embodiment, the protrusions of the first prong 111 and the second prong 113 may be accomplished before the protrusion of the third prong 115. And the receipts of the first prong 111 and the second prong 113 may be accomplished after the receipt of the third prong 115. In other words, the rotations of the first hinge member 131 and the second hinge member 133 are separated, sequential, and independent with respect to each other. In the following embodiments, a linkage portion connecting the first and second hinge members 131 and 133 is provided, whereby the second hinge member 133 is rotated along with the first hinge member 131 simultaneously.

Figure 3:
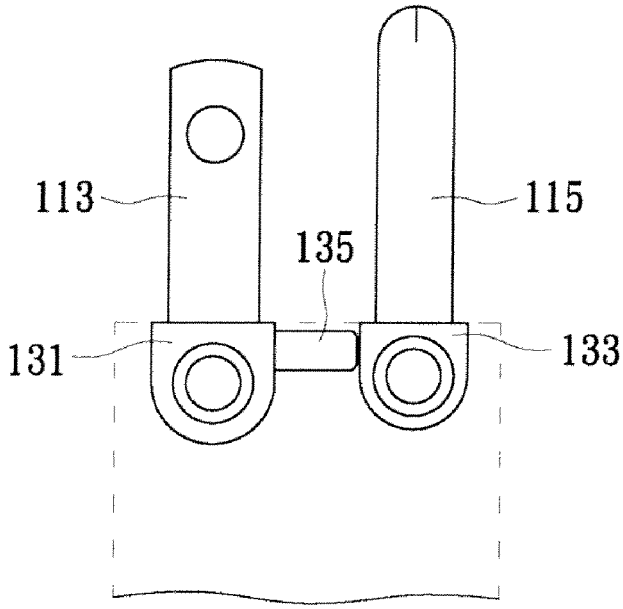
FIG. 3 is a schematic view of a linkage portion in accordance with a first embodiment of the present invention.

Referring to FIG. 3, for the sake of illustration, only the linkage portion, the first hinge member, the second hinge member and the first, second and third prongs are shown with other elements not displayed. In this embodiment, the linkage portion is a protrusion 135 disposed on one side of the first hinge member 131. When the first prong 111, the second prong 113 and the third prong 115 protrude, the protrusion 135 abuts the second hinge member 133. When the first prong 111 and the second prong 113 are rotated by the first hinge member 131 to move toward the third prong 115 the protrusion 135 may become rotatable by no longer abutting the second hinge member 133.

When the first prong 111 and the second prong 113 are received in the accommodating portion 101 (i.e., the first hinge member 131 is rotated to its maximum extent), the protrusion 135 is also received in the accommodating portion 101 with no contact with the second hinge member 133. When the first prong 111 and the second prong 113 are rotated in order to be protruding, the protrusion 135 contacts and pushes the second hinge member 133 to rotate simultaneously in a direction opposite to the direction in which first hinge member 131 rotates.

Figure 4:
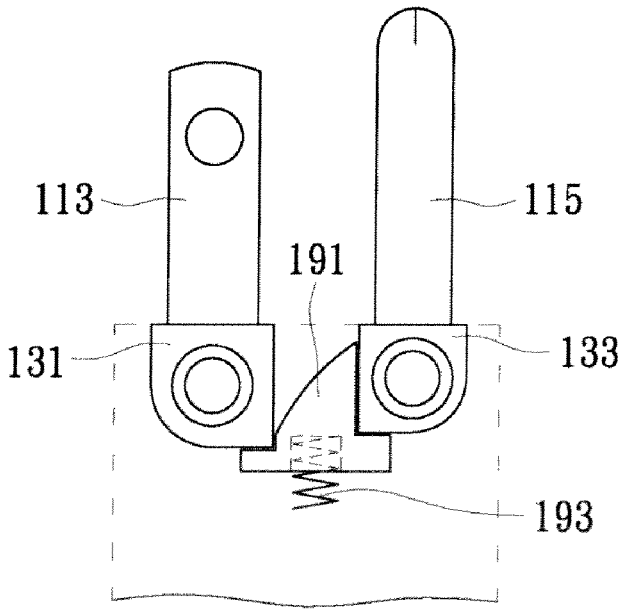
FIG. 4 is a schematic view of the linkage portion in accordance with a second embodiment of the present invention.

Referring to FIG. 4, the linkage portion is a stop portion 191 disposed between the first hinge member 131 and the second hinge member 133. An elastic member 193 biases the stop portion 191 whereby the stop portion 191 is capable of moving upward and downward in the accommodating portion 101. When the first prong 111 and the second prong 113 are rotated to be received in the accommodating portion 101, the first hinge member 131 pushes the stop portion 191 to move downward. When the first prong 111 and the second prong 113 are received in the accommodating portion 101, the stop portion 191 moves to its respective lowest position to be no longer in contact with the second hinge member 133, causing the third prong 115 to be selectively received in the recess 140. When the entire first prong 111, the second prong 113, and the third prong 115 protrude, the elastic member 193 moves the stop portion 191 to abut the second hinge member 133. The elastic member 193 may be a spring or a flexible piece. The accommodating portion 101 further has a latch member (not shown) to lock the movable stop portion 191.

Figure 5:
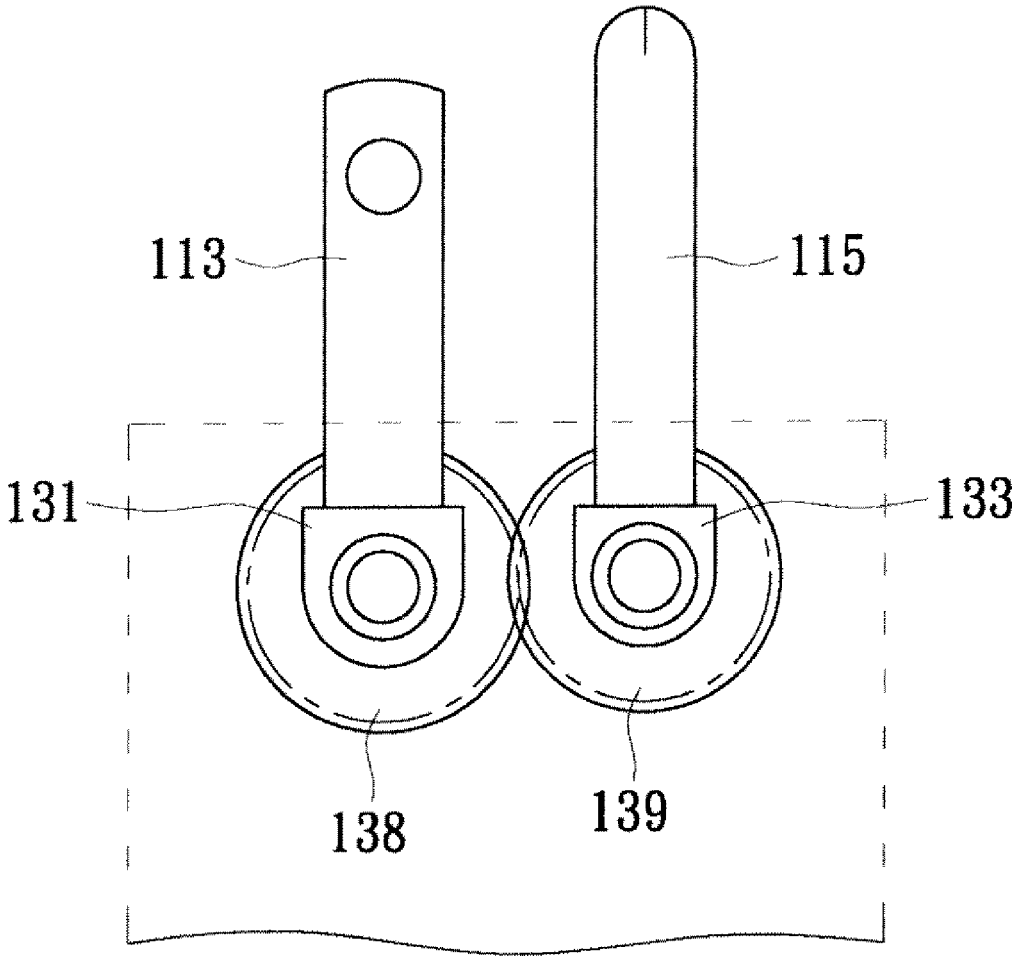
FIG. 5 is a schematic view of the linkage portion in accordance with a third embodiment of the present invention.

Referring to FIG. 5, the linkage portion has a first gear portion 138 and a second gear portion 139 disposed on the first hinge member 131 and the second hinge member 133, respectively. The first gear portion 138 engages the second gear portion 139, whereby the first hinge member 131 and the second hinge member 133 may rotate in opposite directions simultaneously. The first prong 111, the second prong 113, and the third prong 115 may thus protrude or incline simultaneously to ensure the third prong 115 is not to be received alone. The first gear portion 138 and the second gear portion 139 may be an entire gear or a portion thereof.

Figure 6:
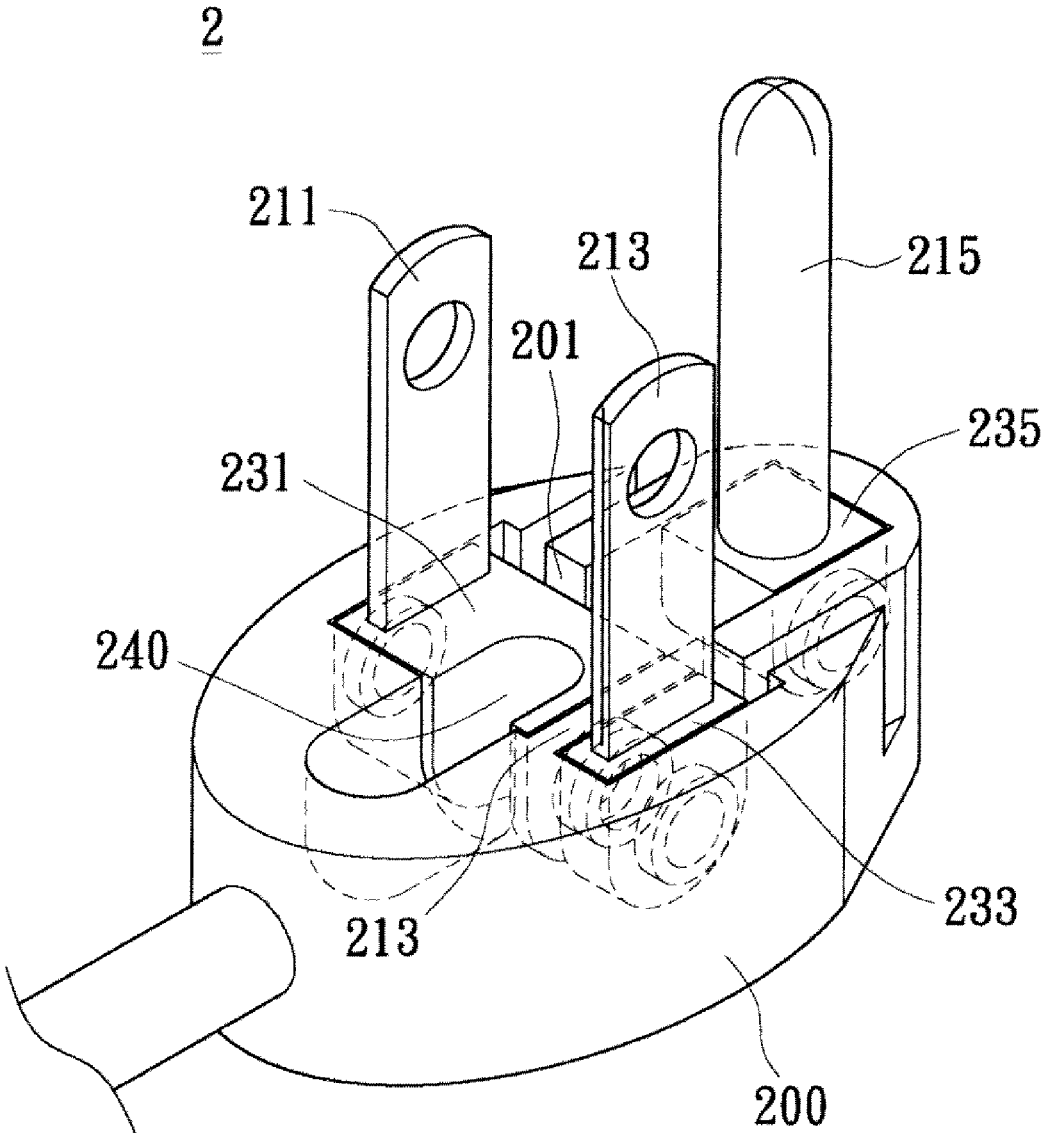
FIG. 6 is a schematic view of the electrical plug in accordance with a third embodiment of the present invention.

Referring to FIG. 6, the embodiment of FIG. 6 is similar to the embodiment of FIG. 4. In this embodiment, however, an electrical plug 2 has three hinge members including the first hinge member 231, the second hinge member 233, and the third hinge member 235. The first hinge member 231, the second hinge member 233, and the third hinge member 235 are rotatably disposed in the accommodating portion 201. The recess 240 may be formed in the first hinge member 231 or in the second hinge member 233. If the recess 240 is formed in the first hinge member 231, the ground prong 215 is selectively received in the recess 240 when the live prong 211 disposed in the first hinge member 231 is received in the accommodating member 201. If the recess 240 is formed in the second hinge member 233, the ground prong 215 is selectively received in the recess 240 when the neutral prong 213 disposed in the second hinge member 233 is received in the accommodating member 201.

In this embodiment, a linkage portion (not shown), such as a protrusion, a stop portion or gear portions, may be disposed between the first hinge member 231 and the third hinge member 235 or between the second hinge member 233 and the third member 235. For example, when the recess 240 is formed in the first hinge member 231, the linkage portion connecting the first hinge member 231 and third hinge members 235 may thus cause the first hinge member 231 and third hinge members 235 to rotate in opposite directions simultaneously to ensure the live prong 211 and the neutral prong 213 may not be utilized without the ground prong 215 being involved.

The electrical plug of the invention comprises the rotatable hinge member connecting the prongs, whereby the prongs may be received in the base in a predetermined sequential fashion. Accordingly, only a limited space may be required for the accommodation of the prongs.

While the invention has been described in terms of what is presently considered to be the most practical and preferred embodiments, it is to be understood that the invention needs not be limited to the disclosed embodiment. On the contrary, it is intended to cover various modifications and similar arrangements included within the spirit and scope of the appended claims which are to be accorded with the broadest interpretation so as to encompass all such modifications and similar structures.

What is claimed is:

1. An electrical plug having rotatable prongs, comprising:

a base having an accommodating portion;

a first hinge member rotatably disposed in the accommodating portion and having a recess;

a first prong having one end connected to the first hinge member;

a second prong having one end connected to the first hinge member;

a second hinge member rotatably disposed in the accommodating portion;

a linkage portion connecting the first hinge member and the second hinge member in such a manner that the first hinge member and the second hinge member rotate in opposite directions simultaneously; and a third prong having one end connected to the second hinge member, wherein the first prong and the second prong are rotated by the first hinge member in order to be selectively received in the accommodating portion; when the first prong and the second prong are received in the accommodating portion, the third prong is selectively rotated to be received in the recess, and the recess is between the first prong and the second prong.

2. The electrical plug having rotatable prongs as claimed in claim 1, wherein the linkage portion comprises a first gear portion disposed on the first hinge member and a second gear portion disposed on the second hinge member to engage with the first gear portion.

3. The electrical plug having rotatable prongs as claimed in claim 1, wherein the linkage portion comprises a protrusion disposed on the first hinge member, wherein when the first prong, the second prong, and the third prong protrude the protrusion abuts the second hinge member, and when the first prong and the second prong rotates to cause the protrusion to be in no contact with the second hinge member the first prong, the second prong, and the third prong are capable of rotating to be received in the accommodating portion, and when the first prong and the second prong are rotated to be protruding the protrusion pushes the second hinge member to rotate in a direction opposite to an direction in which the first hinge member rotates.

4. The electrical plug having rotatable prongs as claimed in claim 1, wherein the linkage portion comprises a stop portion and an elastic member disposed on the stop portion, wherein when the first prong, the second prong, and the third prong protrude the elastic member biases the stop portion to abut the second hinge member, and when the first prong and the second prongs rotate the first hinge member pushes the stop portion down to cause the second hinge member to be in no contact with the second hinge member so that the first prong, the second prong, and the third prong are capable of rotating to be received in the accommodating portion.

5. An electrical plug having rotatable prongs, comprising:

a base having an accommodating portion;

a first hinge member rotatably disposed in the accommodating portion;

at least one prong having one end connected to the first hinge member;

a second hinge member rotatably disposed in the accommodating portion;

a linkage portion connecting the first hinge member and the second hinge member in such a manner that the first hinge member and the second hinge member rotate in opposite directions simultaneously; and a ground prong having one end connected to the second hinge member, wherein the at least one prong is rotated by the first hinge member in order to be selectively received in the accommodating portion; when the at least one prong is received in the accommodating portion, the ground prong is selectively rotated to be disposed adjacent to the at least one prong.

6. The electrical plug having rotatable prongs as claimed in claim 5, wherein the linkage portion comprises a first gear portion disposed on the first hinge member and a second gear portion disposed on the second hinge member to engage with the first gear portion.

7. The electrical plug having rotatable prongs as claimed in claim 5, wherein the at least one prong includes a first prong and a second prong, a recess is formed between the first prong and the second prong to receive the ground prong.

8. The electrical plug having rotatable prongs as claimed in claim 7, wherein the linkage portion comprises a protrusion disposed on the first hinge member, wherein when the first prong, the second prong, and the third prong protrude the protrusion abuts the second hinge member, and when the first prong and the second prong rotates to cause the protrusion to be in no contact with the second hinge member the first prong, the second prong, and the third prong are capable of rotating to be received in the accommodating portion, and when the first prong and the second prong are rotated to be protruding the protrusion pushes the second hinge member to rotate in a direction opposite to an direction in which the first hinge member rotates.

9. The electrical plug having rotatable prongs as claimed in claim 7, wherein the linkage portion comprises a stop portion and an elastic member disposed on the stop portion, wherein when the first prong, the second prong, and the third prong protrude the elastic member biases the stop portion to abut the second hinge member, and when the first prong and the second prongs rotate the first hinge member pushes the stop portion down to cause the second hinge member to be in no contact with the second hinge member so that the first prong, the second prong, and the third prong are capable of rotating to be received in the accommodating portion.

* * * * *